US008567414B2

(12) United States Patent
Rivola

(10) Patent No.: US 8,567,414 B2
(45) Date of Patent: Oct. 29, 2013

(54) ELECTRICAL APPARATUS FOR HAIR STYLING

(75) Inventor: Marco Rivola, Cenate Sopra (IT)

(73) Assignee: Tenacta Group S.p.A., Azzano San Paolo (IT)

( * ) Notice: Subject to any disclaimer, the term of this patent is extended or adjusted under 35 U.S.C. 154(b) by 15 days.

(21) Appl. No.: 13/049,040

(22) Filed: Mar. 16, 2011

(65) Prior Publication Data

US 2011/0226278 A1 Sep. 22, 2011

(30) Foreign Application Priority Data

Mar. 17, 2010 (IT) ..... MI2010A0432

(51) Int. Cl.
*A45D 1/00* (2006.01)
*A45D 1/06* (2006.01)

(52) U.S. Cl.
USPC ..... 132/224; 132/232; 132/269; 132/271

(58) Field of Classification Search
USPC ..... 132/223, 224, 225, 227, 229, 232, 263, 132/265, 269, 271; 219/222–226
IPC ..... A45D 1/00,1/02, 1/06
See application file for complete search history.

(56) References Cited

U.S. PATENT DOCUMENTS

| | | | | | |
|---|---|---|---|---|---|
| 1,014,952 | A * | 1/1912 | Cox | | 132/224 |
| 1,611,959 | A * | 12/1926 | Taylor | | 132/224 |
| 1,845,208 | A | 7/1931 | Tankins | | |
| 2,910,988 | A | 2/1956 | Treadaway | | |
| 3,150,393 | A * | 9/1964 | Crookes et al. | | 15/23 |
| 3,859,497 | A * | 1/1975 | McNair | | 219/225 |
| 4,329,567 | A * | 5/1982 | Kunz et al. | | 219/222 |
| 4,443,688 | A * | 4/1984 | Andis | | 219/222 |
| 4,829,156 | A * | 5/1989 | Thompson | | 219/225 |
| 6,191,387 | B1 * | 2/2001 | Smal | | 219/225 |
| 6,278,086 | B1 * | 8/2001 | Janouch et al. | | 219/222 |
| 6,604,532 | B1 * | 8/2003 | McClendon et al. | | 132/224 |
| 6,627,852 | B1 * | 9/2003 | Savone | | 219/225 |
| 7,045,744 | B2 * | 5/2006 | Oh | | 219/225 |
| 7,445,012 | B2 * | 11/2008 | Mukai | | 132/224 |
| 2007/0095810 | A1 * | 5/2007 | Gniadek | | 219/225 |
| 2007/0119844 | A1 * | 5/2007 | Lo et al. | | 219/225 |
| 2008/0035167 | A1 * | 2/2008 | Chan | | 132/225 |
| 2009/0114240 | A1 * | 5/2009 | Leung | | 132/224 |
| 2010/0206322 | A1 * | 8/2010 | Mukai | | 132/269 |

(Continued)

FOREIGN PATENT DOCUMENTS

| | | | | |
|---|---|---|---|---|
| GB | 18527 | 0/1914 | | |
| IT | 1102256 | 10/1985 | | |
| JP | 2005237803 A * | 9/2005 | | A45D 1/08 |
| WO | 03039290 A2 | 5/2003 | | |

(Continued)

*Primary Examiner* — Robyn Doan
*Assistant Examiner* — Tatiana Nobrega
(74) *Attorney, Agent, or Firm* — Husch Blackwell LLP

(57) ABSTRACT

Apparatus for hair styling comprising: two handles connected together so as to allow the apparatus to be opened and closed by bringing said handles apart and together, respectively, and two styling elements respectively associated with the two handles, wherein each styling element comprises a roller adapted to rotate about its own longitudinal axis during the styling of the hair, at least one of the rollers comprises a heating element, and at least one of the styling elements comprises elastic means operatively associated with the respective roller, adapted to exert on the roller an elastic force according to a substantially transversal direction perpendicular to the longitudinal axis of rotation of the roller.

16 Claims, 6 Drawing Sheets

(56) References Cited

U.S. PATENT DOCUMENTS

| | | | | |
|---|---|---|---|---|
| 2011/0017225 | A1* | 1/2011 | Devulapalli | 132/118 |
| 2011/0108052 | A1* | 5/2011 | Morgandi et al. | 132/230 |
| 2012/0024311 | A1* | 2/2012 | Linglin et al. | 132/232 |

FOREIGN PATENT DOCUMENTS

| | | | |
|---|---|---|---|
| WO | 2004026070 | A1 | 1/2004 |
| WO | 2005082198 | A1 | 9/2005 |
| WO | 2008132345 | A2 | 11/2008 |

* cited by examiner

ELECTRICAL APPARATUS FOR HAIR STYLING

CROSS-REFERENCE TO RELATED APPLICATIONS

The present application claims priority to and incorporates herein by reference Italian Patent Application Serial No. MI2010A000432 filed on Mar. 17, 2010

DESCRIPTION

The present invention refers to an electrical apparatus for hair styling.

In particular, the present invention refers to an electrical apparatus for hair straightening, curling, waving, or similar.

Electrical apparatuses for hair styling are described, for example, in documents IT 1102256, WO 2004/026070, WO 2005/082198, WO 2008/132345, GB 18527, U.S. Pat. No. 2,910,988, U.S. Pat. No. 1,845,208.

In particular, U.S. Pat. No. 1,845,208 discloses an apparatus comprising a casing from which two rollers project, in which respective heating elements are housed. The heating elements and the rollers are held apart from one another by means of a spring. The apparatus also comprises suitable grips. By applying a pressure on such grips against the action of the spring, it is possible to bring the heating elements and the rollers together. The proximity is controlled by means of an adjustable screw.

The Applicant observes that in such an apparatus the pressure actually applied by the two rollers on the locks of hair is adjusted by means of the aforementioned adjustable screw. Such a screw must be adjusted by hand by a user before and/or while the apparatus is operating.

The Applicant faced the technical problem of providing an apparatus for hair styling that is improved with respect to known apparatuses.

In a first aspect thereof the present invention relates to an apparatus for hair styling comprising:

two handles connected together so as to allow the apparatus to be opened and closed by taking said handles apart and together, respectively, and two styling elements respectively associated with the two handles, each styling element comprising a roller adapted to rotate about its own longitudinal axis during the styling of the hair, at least one of the rollers comprising a heating element and at least one of the styling elements comprising elastic means operatively associated with the respective roller, adapted to exert on the roller an elastic force according to a substantially transversal direction, perpendicular to the longitudinal axis of rotation of the roller.

Throughout the present description and claims, the expression "fixed electrical connection" is used to indicate a motionless electrical connection (not rotating) and it includes both an electrical connection that is stable over time, and that cannot be repeatedly connected and disconnected (like for example an electrical connection made by welding together two electric wires), and an electrical connection of the connectable/disconnectable type (like for example an electrical connection made through a plug and a female socket).

The dependent claims refer to particularly advantageous embodiments of the apparatus of the invention.

Advantageously, each roller is adapted to freely rotate about its own longitudinal axis during the styling of the hair.

Advantageously, said roller is housed inside the respective styling element with the possibility of being able to make, in cooperation with the elastic means, transversal movements according to said transversal direction, within a defined stroke.

Preferably, the elastic force exerted by the elastic means on the roller is directed towards the inside of the apparatus.

Advantageously, the elastic means are housed inside the styling element so as to push the roller towards the inside of the apparatus. In this way, when the apparatus is closed the elastic means push the roller against the other roller.

Advantageously, the opening/closing mechanism of the apparatus is such as to allow the two handles to be taken apart in a substantially unconstrained manner.

In an embodiment, the two handles are hinged together atone of their ends. The other free end of the handles is operatively associated with the respective styling element. Advantageously, the two handles are hinged together so as to allow the two handles to be taken apart by an angular extension of up to 45°, for example 15-20°.

Advantageously, the two styling elements are directly associated with the two handles.

In a preferred embodiment, said at least one roller comprising the heating element is adapted to rotate with respect to the heating element.

Advantageously, the heating element is fixed, i.e. it does not rotate during the styling of the hair.

Preferably, said heating element is connected to an electrical power supply, situated in the respective handle, through a fixed electrical connection.

In an embodiment, the two styling elements are associated with the two handles in a fixed manner. Preferably, said heating element is connected directly to the electrical power supply situated in the respective handle.

In an embodiment, the two styling elements are connected to the two handles in a disconnectable manner and said fixed electrical connection between the heating element and the electrical power supply situated in the respective handle is of the disconnectable type.

Advantageously, said heating element is housed inside the'respective roller.

Preferably, said heating element is housed inside the respective roller with a certain clearance adapted to allow the roller to rotate about the heating element.

Preferably, between the roller and the heating element a rolling member is arranged that is adapted to facilitate the rotation of the roller with respect to the heating element.

For example, the rolling member is a bushing or a rolling bearing.

Advantageously, said rolling member comprises a heat conducting material.

Preferably, said heat conducting material is also self-lubricating or said rolling member is coated with a coating of self-lubricating material.

In an embodiment, the heating element is housed inside a cylindrical element that, in turn, is housed inside the respective roller. Said clearance is in this case formed between the cylindrical element and the roller.

Advantageously, the two styling elements each comprise a housing in which the respective roller is housed in such a way as to freely rotate with respect to the housing, the housings being configured so as to cover the rollers for an angular extension of less than 360°, the rollers thus being able to face one another and cooperate with each other for the styling of the hair, when the handles of the apparatus are in closed position.

The rollers can have a smooth, toothed or wavy outer surface.

In a preferred embodiment, at least one of the two styling elements is equipped with a comb element suitable for holding a lock of hair to be styled in position.

Further characteristics and advantages of the apparatus of the present invention will become clearer from the following detailed description of some preferred embodiments thereof, made as an example and not for limiting purposes with reference to the attached drawings.

Figure 1:
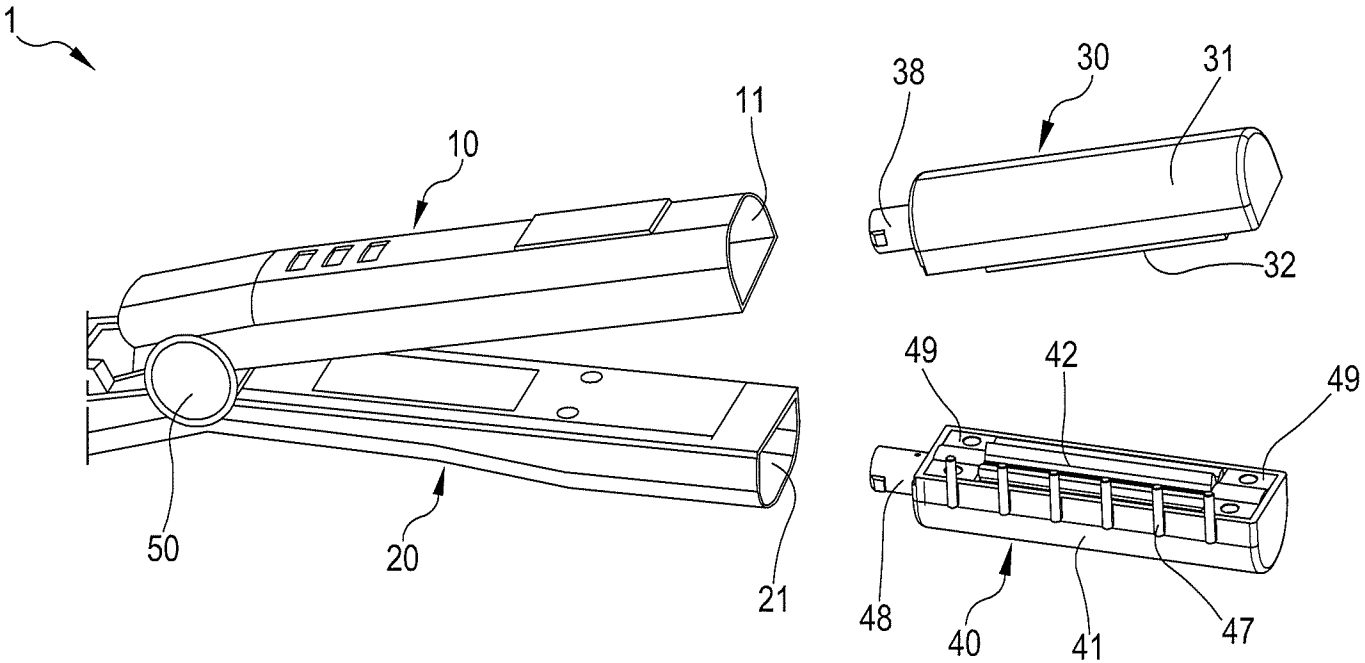
FIG. 1 is a perspective view of an apparatus for hair styling according to an embodiment according to the invention.

In the figures, reference numeral 1 indicates an apparatus for hair styling (in the example an electric hair iron for waving hair) according to an embodiment of the invention. The apparatus 1 comprises two handles 10, 20 (shown in FIG. 1 in open position) and two styling elements 30, 40.

The two handles 10, 20 are connected together so as to allow the apparatus 1 to be opened and closed by taking said handles 10, 20 apart and together, respectively.

In the illustrated embodiment, the two handles 10, 20 are connected together at one end by a single hinge 50. The hinge 50 allows the two handles 10, 20 to rotate about a hinging axis, between an open position and a closed position of the apparatus 1. For example, in the open position, the two handles 10, 20 can be moved apart by a maximum angular extension of 45°, for example from 15 to 20°.

Typically, the hinge 50 is associated with elastic means configured so as to hold the apparatus in an open rest position.

In the illustrated embodiment, the two free ends 11, 21, not hinged, of the two handles 10, 20 are adapted to be connected in a disconnectable manner to the two styling elements 30, 40. The removable connection can be made through quick fastening systems known in the art. In FIG. 1, the two connection elements 30, 40 are equipped with two coupling appendages 38, 48 suitable for snap-insertion inside the two free ends 11, 21 of the two handles 10, 20.

This embodiment with the disconnectable styling elements 30, 40 is advantageous since it allows different pairs of styling elements to be connected/disconnected to/from the two handles 10, 20, according to the different requirements that the user may have each time.

However, the invention also applies to the case in which the styling elements 30, 40 are connected in a stable manner to the two handles 10, 20. In this case, the two handles 10, 20 and the two styling elements 30, 40 can be made in two respective single pieces or they can be firmly fixed together (for example through screws, welding or similar).

The two styling elements 30, 40 each comprise a protective half-shell 31, 41 inside which a roller 32, 42 is housed.

The half-shells 31, 41 are advantageously made from insulating material. Moreover, they are adapted to cover the rollers 32, 42 for an angular extension of less than 360° and, typically at least 180° (for example around 180°), so as to allow the two rollers 32, 42 to face one another and cooperate with each other for the styling of the hair, when the handles 10, 20 are in closed position (i.e. when the apparatus 1 is in operative styling position).

The rollers 32, 42 are hollow cylindrical elements adapted to freely rotate about their own longitudinal axis and they are coupled with the respective half-shells 31, 41 in a rotary manner. By roller adapted to freely rotate it is meant a roller that is adapted to be set in rotation under the action of an external force and to continue to rotate by inertia, even when the external force stops, until it stops by friction or application of a further external force.

The longitudinal axis of the rollers 32, 42 is advantageously perpendicular to the hinging axis about which the handles 10, 20 are hinged.

The rollers 32, 42 comprise a heating element 34, 44 inside them.

Advantageously, the rollers 32, 42 are made from heat conducting material, so as to optimise the heat transfer from the heating element 34, 44 to the hair to be styled.

The heating elements 34, 44 can be of the resistive type, PTCs (positive temperature coefficient heaters), ceramic heaters, wire-type heaters, infrared heaters and the like. Moreover, they can have any cross section (square, rectangular, round).

The heating elements 34, 44 are adapted to be connected to electric wires (not shown in the figures) present in the handles 10, 20, which are adapted to be fed by the electrical power mains.

Although not shown in the figures, the apparatus 1 is advantageously connected to a power supply cable for the connection to the electrical power mains and to supply electrical energy to the heating elements 34, 44, through the aforementioned electrical wires inside the handles 10, 20.

In a variant (also not shown), the apparatus could also be adapted to operate with batteries (for example rechargeable batteries).

The apparatus 1 advantageously also comprises adjustment means (not shown) for adjusting the temperature of the heating elements 34, 44. Such adjustment means are not described in detail because they can be made according to techniques well known in the art.

According to a preferred embodiment of the invention, the heating elements 34, 44, housed inside the rollers 32, 42, are fixed (not rotating) and the rollers 32, 42 are adapted to freely rotate about them.

This advantageously allows a fixed electrical connection to be made between the heating elements 34, 44 and the electrical wires present inside the handles 10, 20 and makes it possible to avoid the sliding rotary contacts used in some apparatuses of the prior art that are not very reliable or safe.

For example, in the illustrated embodiment in which the styling elements 30, 40 can be disconnected from the handles 10, 20, electrical wires 340 coming out from the heating elements 34, 44 can end directly with rigid pins (not shown) adapted to make an electrical connection with a suitable female socket (not shown) present in the handles 10, 20. When the styling elements 30, 40 are connected to the handles 10, 20, the electrical connection between the heating elements 34, 44 and the electrical power supply is fixed, not rotary.

On the other hand, in the non-illustrated case in which the styling elements 30, 40 are integrally connected, in such a way that they cannot be disconnected, to the handles 10, 20, the electric wires 340 coming out from the heating elements 34, 44 can be directly connected in a fixed manner to the electrical wires present in the handles 10, 20, for example through welding.

Considering that the heating elements 34, 44 can have a variable shape, in a preferred embodiment, of the invention they are housed inside a cylindrical element 35, 45 that acts as an adapter, with the function of configuring the heating elements 34, 44 to the cylindrical shape of the inner surface of the rollers 32, 42.

Therefore, in the illustrated preferred embodiment, the rollers 32, 42 each comprise such a cylindrical element 35, 45 inside them, inside which the heating element 34, 44 is in turn inserted.

The cylindrical element 35, 45 is advantageously made from heat conducting material (like for example bronze, aluminum, steel or similar).

The cylindrical element 35, 45 is inserted inside the respective roller 32, 42 with a certain clearance (indicated with reference numerals 36, 46 in FIG. 6) so as to allow the roller 32, 42 to rotate about it.

In order to facilitate the rotation of the rollers and to ensure a good transmission of heat despite the rotation of the rollers 32, 42 with respect to the heating elements 34, 44, a bushing or rolling bearing (not shown), made from heat conducting material (like, for example, bronze, aluminum, steel or similar), is advantageously inserted in the clearance 36, 46 between the roller 32, 42 and the fixed cylindrical element 35, 45.

In order to further facilitate the rotation of the roller 32, 42 with respect to the fixed cylindrical element 35, 45, the bushing (or bearing) is advantageously made from a material that is simultaneously heat conducting and self-lubricating (like for example bronze). Otherwise, the bushing (or bearing) is advantageously made from heat conducting material (like for example bronze, aluminum, steel or similar) and is coated with a thin film (for example a few tenths of one mm) of self-lubricating material (like teflon or similar).

The rollers 32, 42 therefore act as rotors whereas the fixed cylindrical elements 35, 45 with the heating elements 34, 44 inside them act as stators.

The assembly of roller 32, 42, fixed cylindrical element 35, 45 and heating element 34, 44 is housed entirely inside the respective half-shell 31, 41. Such an assembly is bound to the respective half-shell 31, 41 through, for example, plates 39, 49—fixed through screws to the shells 31, 41—which bind the ends of the fixed cylindrical elements 35, 45 to the shells 31, 41.

In particular, the aforementioned assembly is fixed inside the respective half-shell so as to be constrained in its movements, with the exception of the roller that freely rotates about the respective fixed cylindrical element 35, 45, heating element 34, 44 and half-shell 31, 41.

According to the invention, the rollers 32, 42 are suspended inside the respective half-shells 31, 41 through elastic means.

Figure 2:
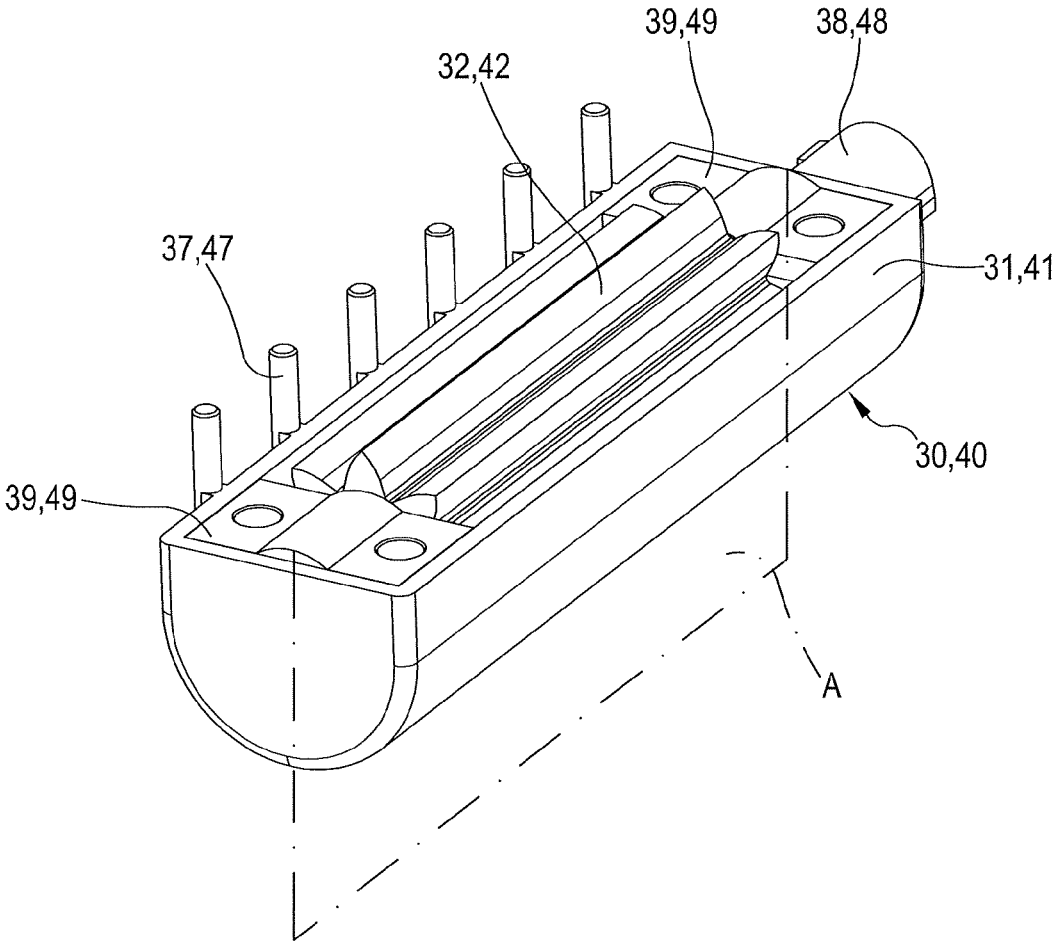
FIG. 2 is a perspective view of a styling element of the apparatus of FIG. 1.
Figure 3:
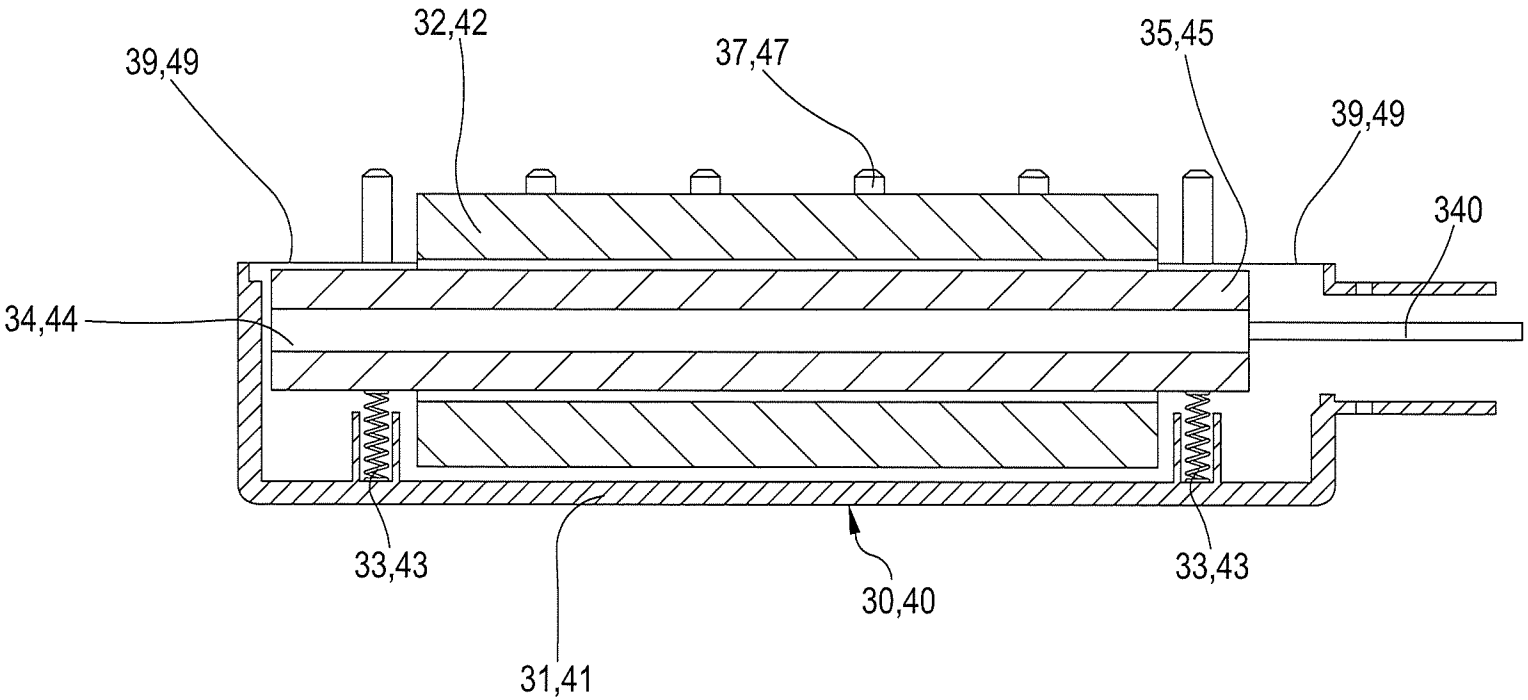
FIG. 3 is a longitudinal section view of the styling element of FIG. 2, taken on the plane A of FIG. 2.
Figure 4:
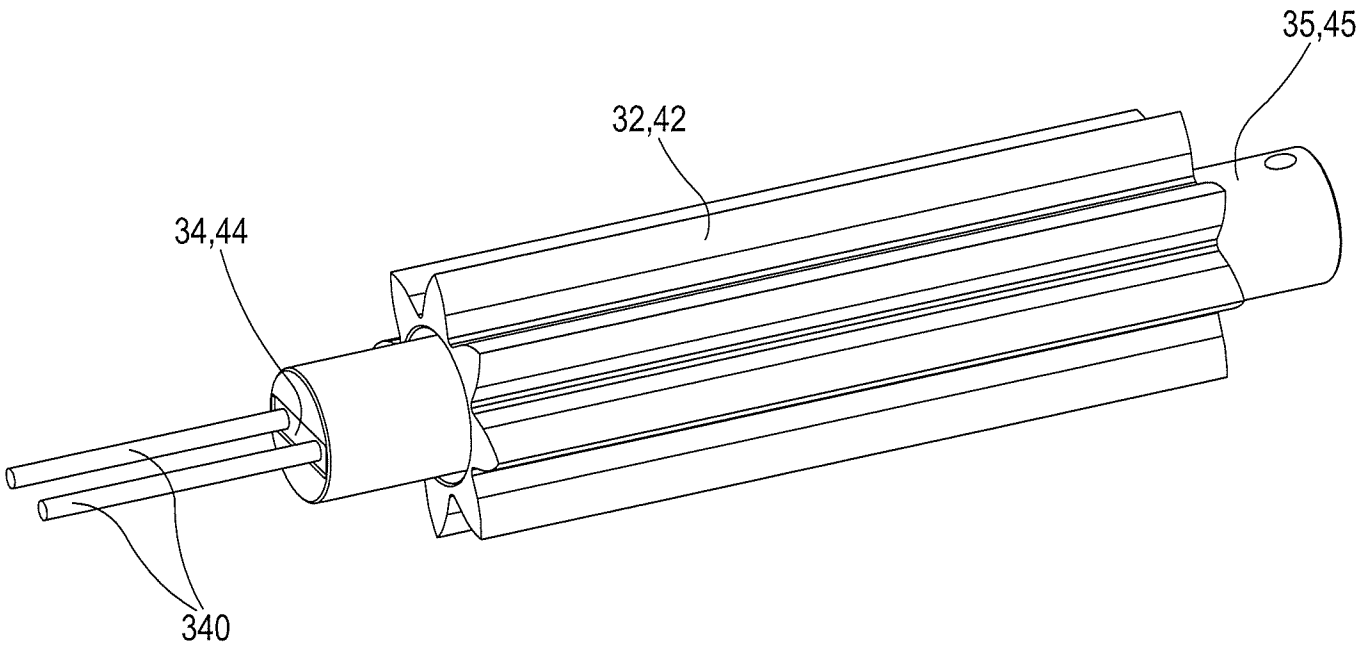
FIG. 4 is a perspective view of an assembly of roller, cylindrical element and heating element of the styling element of FIG. 2.
Figure 5:
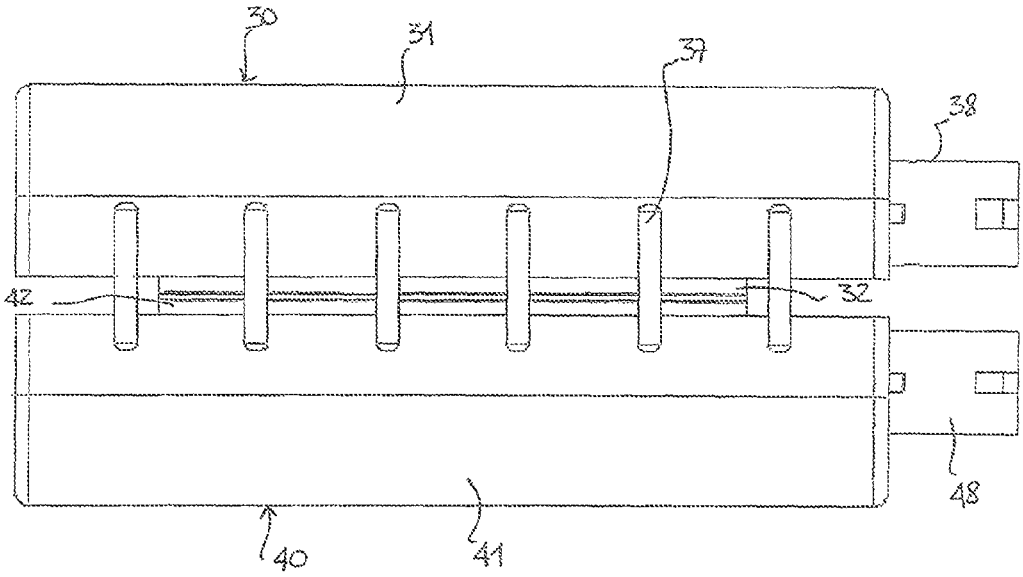
FIG. 5 is a side view of two styling elements according to the embodiment of FIG. 2, in closed position.

As can be seen in FIG. 3, in the plane A of FIG. 2 the elastic means are adapted to exert on the rollers 32, 42 an elastic force according to a transversal direction perpendicular to the longitudinal axis of rotation of the roller (32, 42). Such an elastic force is also perpendicular to the hinging axis about which the handles 10, 20 are hinged.

Advantageously, the elastic means are positioned so as to push the rollers 32, 42 towards the inside of the apparatus 1. In this way, when the apparatus 1 is closed the elastic means tend to hold the rollers 32, 42 against one another.

In the embodiment illustrated in FIG. 3 the elastic means comprise two springs 33, 43. The two springs 33, 43 are positioned inside the half-shells 31, 41 at two opposite ends of the cylindrical elements 35, 45.

Although not shown in the figures, the invention also applies to the cases in which the number of elastic means is different from two (for example, also to the case of one or three springs) and also to the case of elastic means different from springs (for example the elastic means can be made from rubber elements or other elastic materials).

Moreover, the invention also applies to the case in which the elastic means are associated with a single roller.

Each roller 32, 42 is advantageously fixed inside the respective half-shell 31, 41 with the possibility of making—in cooperation with the elastic means 33, 43—some small movements according to the transversal direction perpendicular to the longitudinal axis of the roller.

In particular, the aforementioned assembly of roller 32, 42, cylindrical element 35, 45 and heating element 34, 44 is fixed inside the respective half-shell 31, 41 so as to be able to make some small transversal movements, within the limits of the stroke defined by the elastic means 33, 43.

For example, such a stroke can be greater than 0, than 0.5 or 1.5 mm.

For example, such a stroke can be less than 4, than 3 or 2 mm.

When a user inserts a lock of hair between the two styling elements 30, 40 and closes the apparatus 1, the elastic means act so as to automatically adapt the distance between the facing surfaces of the two rollers 32, 42 to the thickness of the lock of hair.

The invention is thus particularly advantageous because it makes it possible to automatically adjust the distance between the facing surfaces of the two rollers 32, 42, and thus the pressure actually exerted by the rollers 32, 42 on a hair lock, according to the thickness of the lock actually inserted in the apparatus 1.

This allows the apparatus 1 of the invention to effectively style all types of locks, both thick ones and thin ones and allows a single lock of hair to be styled uniformly, from the root to the tips, in an automatic manner without requiring manual interventions by the user.

It should be observed that the preferred embodiment of the invention, in which there is the combination of the following characteristics: non-rotating heating elements 34, 44 and rotating rollers 32, 42 associated with elastic suspension means 33, 43, advantageously allows the distance between the rollers 32, 42 to be automatically adjusted according to the lock of hair that is styled and at the same time ensures a stable and safe electrical coupling between the heating elements 34, 44 and the electrical power supply present in the handles 10, 20. Indeed, thanks to the fact that the heating elements 34, 44 are fixed and coupled in a stable manner with the electrical power supply present in the handles 10, 20, this preferred embodiment of the invention makes it possible to ensure a stable and safe electrical coupling even when there are transversal movements made by the rollers in cooperation with the elastic means 33, 43.

In general, the outer styling surface of the rollers 32, 42 can be smooth, toothed or wavy.

The smooth surface is particularly useful in the case of straightening actions whereas the toothed or wavy surface is particularly useful in the case of curling or waving actions on the hair.

Figure 6:
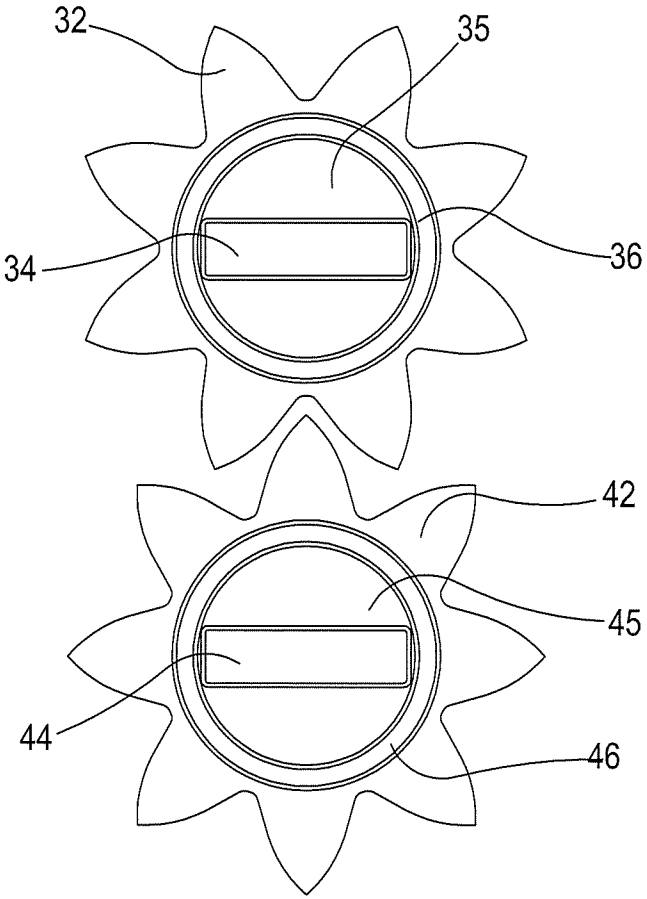
FIG. 6 shows a cross section of the rollers of the apparatus of FIG. 1, engaged with one another in a complementary way.

For example, FIG. 6 shows an embodiment in which the outer surface of the rollers 32, 42 comprises a plurality of teeth and the two rollers are positioned inside the respective half-shells 31, 41 so that when the handles 10, 20 of the apparatus 1 are closed the teeth cooperate with one another engaging in a complementary fashion.

The shape, number and size of the teeth can be of various types, according to the styling effect that it is wished to obtain.

Preferably, two comb-shaped elements 37, 47 are respectively foreseen on opposite sides of the half-shells 31, 41 or on the opposite sides of the same half-shell 31, 41, to ensure that the lock of hair inserted between the two rollers 32, 42 stays in position during the styling.

At the moment of use, the user switches on the apparatus 1, waits for the heating elements 34, 44 to reach the optimal temperature, selects a lock of hair, inserts the lock between the two rollers 32, 42, closes the handles 10, 20 and moves the apparatus 1 so as to run the rollers 32, 42 from the root to the tip of the lock. During this movement, the rollers mutually rotate and, thanks to the elastic means, automatically adapt their mutual distance to the thickness of the lock of hair to be styled.

The size, the shapes, the positions and the orientations of the various components of the apparatus can be subjected to different modifications. Components that are shown in contact or directly connected can have component interposed. The functions performed by one element can be performed by two or more elements and vice-versa. The structures and functions described in one embodiment can be adopted in another of the embodiments described. Not all of the advantageous characteristics must necessarily be present in the same embodiment. Every new and innovative characteristic must be considered described as an innovation in itself.

The invention claimed is:

1. An apparatus for hair styling comprising:

two handles connected together so as to allow the apparatus to be opened and closed by bringing said handles apart and together, respectively, and two styling elements respectively associated with the two handles, wherein:

each styling element comprises a roller having a distal end and a proximal end adapted to rotate about its own longitudinal axis during the styling of the hair, at least one of said rollers defining an open, cylindrical area passing through a length of said roller along said roller's longitudinal axis;

a cylindrical element arranged within said open, cylindrical area of said at least one roller, said cylindrical element having a central opening along said cylindrical element's longitudinal axis and having a distal end and a proximal end; wherein the distal end of the cylindrical element extends beyond the distal end of the roller and the proximal end of the cylindrical element extends beyond the proximal end of the roller;

a heating element arranged within said central opening of said cylindrical element;

wherein said roller is adapted to rotate with respect to said cylindrical element and said heating element; and at least one of the styling elements comprises a resilient element operatively associated with the respective roller, adapted to exert on the roller an elastic force according to a substantially transversal direction, perpendicular to the longitudinal axis of rotation of the roller, said resilient element is coupled to the distal end and/or the proximal end of said cylindrical element beyond the distal end and/or the proximal end of the roller respectively to exert an elastic force on the cylindrical element and the heating element, which as an unit exerts an elastic force on said roller.

2. The apparatus according to claim 1, wherein the elastic force exerted by the resilient element on the cylindrical element, and consequently the roller, is directed towards the inside of the apparatus.

3. The apparatus according to claim 1, wherein said roller is housed inside the respective styling element with the possibility of making, in cooperation with the resilient element, transversal movements according to said transversal direction, within a delimited stroke.

4. The apparatus according to claim 1, wherein the two handles are hinged together.

5. The apparatus according to claim 1, wherein said heating element is connected to an electrical power supply situated in the respective handle through a fixed electrical connection.

6. The apparatus according to claim 5, wherein the two styling elements are connected to the two handles in a disconnectable manner and said fixed electrical connection between the heating element and the electrical power supply situated in the respective handle is of the disconnectable type.

7. The apparatus according to claim 1, wherein said cylindrical element is arranged within said open, cylindrical area of the respective roller with a certain clearance adapted to allow the roller to rotate about the cylindrical element.

8. The apparatus according to claim 7, wherein between the roller and the cylindrical element a rolling member is arranged that is adapted to facilitate the rotation of the roller with respect to the cylindrical element.

9. The apparatus according to claim 8, wherein said rolling member is a bushing or a rolling bearing.

10. The apparatus according to claim 8, wherein said rolling member comprises a heat conducting material.

11. The apparatus according to claim 10, wherein said heat conducting material is also self-lubricating.

12. The apparatus according to claim 10, wherein the rolling member is coated with a coating made from self-lubricating material.

13. The apparatus according to claim 1, wherein the two styling elements each comprise a housing in which the respective roller is housed so as to freely rotate with respect to the housing, the housings being configured so as to cover the rollers for an angular extension of less than 360°, the rollers thus being able to face one another and cooperate with one another for the styling of the hair, when the handles of the apparatus are in closed position.

14. The apparatus according to claim 1, wherein said resilient element is at least one spring.

15. The apparatus according to claim 1, wherein said resilient element is an elastic material.

16. The apparatus according to claim 15, wherein said elastic material is at least one rubber element.

* * * * *